United States Patent [19]

Eckell et al.

[11] Patent Number: 4,840,161

[45] Date of Patent: Jun. 20, 1989

[54] FUEL INJECTION PUMP FOR INTERNAL COMBUSTION ENGINES

[75] Inventors: Wolfgang Eckell, Leonberg; Josef Guentert, Gerlingen; Walter Haefele, Fellbach; Manfred Kraemer, Schwieberdingen; Uwe Kuhn, Riederich; Johann Warga, Bietigheim-Bissingen, all of Fed. Rep. of Germany

[73] Assignee: Robert Bosch GmbH, Stuttgart, Fed. Rep. of Germany

[21] Appl. No.: 213,044

[22] Filed: Jun. 29, 1988

[30] Foreign Application Priority Data

Jul. 25, 1987 [DE] Fed. Rep. of Germany ..... 3724662

[51] Int. Cl.[4] ..... F02M 39/00

[52] U.S. Cl. ..... 123/500; 123/495; 123/503; 417/499

[58] Field of Search ..... 123/500, 501, 503, 357, 123/358, 359, 372, 373, 364, 449, 495; 417/494, 499, 426, 428

[56] References Cited

U.S. PATENT DOCUMENTS

| | | | |
|---|---|---|---|
| 3,712,763 | 1/1973 | Parks | 417/499 |
| 4,418,675 | 12/1983 | Nifmeier | 123/501 |
| 4,457,285 | 7/1984 | Sazzgeber | 123/501 |
| 4,531,492 | 7/1985 | Gibson | 123/364 |
| 4,541,391 | 9/1985 | Gibson | 123/364 |
| 4,619,233 | 10/1986 | Yamaguchi | 123/357 |
| 4,661,051 | 4/1987 | Nakamura et al. | 417/499 |
| 4,705,005 | 11/1987 | Güntert | 123/500 |
| 4,706,626 | 11/1987 | Hafele | 123/364 |
| 4,708,114 | 11/1987 | Güntert | 123/500 |
| 4,737,085 | 4/1988 | Güntert | 123/501 |
| 4,737,086 | 4/1988 | Yamaguchi | 123/500 |
| 4,763,631 | 8/1988 | Fehlman | 123/503 |

*Primary Examiner*—Carl Stuart Miller
*Attorney, Agent, or Firm*—Edwin E. Greigg

[57] ABSTRACT

A fuel injection pump for internal combustion engines, in particular having a plurality of linearly aligned pump elements, the pump injection onset is determined by one control slide per pump element in which the control slide is axially displaceable on the pump plunger and by a control of relief conduits of the pump work chambers. The control slide is actuated via a torque shaft in that a respective adjusting bolt of a straddling element joined to the torque shaft engages a cross groove of the control slide. The adjusting bolt has a cylindrical stud portion and a slide shoe supported thereon, and the slide shoe is secured against axial displacement by means of a head of the adjusting bolt.

20 Claims, 3 Drawing Sheets

FUEL INJECTION PUMP FOR INTERNAL COMBUSTION ENGINES

RELATED PATENT APPLICATION

This application is copending with application Ser. No. 941,866 filed Dec. 15, 1986; Ser. No. 108,503 filed Oct. 14, 1987 and Ser. No. 135,157 filed on Nov. 18, 1987; each of which are assigned to the same assignee.

BACKGROUND OF THE INVENTION

The invention is based on a fuel injection pump as generically defined hereinafter.

A major problem in fuel injection pumps of this type, typically embodied as multi-cylinder pumps having a number of pump elements, is the precise orientation of the various control slides, when these slides are adjusted in common by the torque shaft in order to vary the instant of injection or the injection quantity. Even slight differences in the adjustment of the various control slides upon actuation by the torque shaft can lead to considerable error in the control of injection onset of injection quantity, which can cause rough engine operation or deviations from the intended rpm.

Such differences may be due solely to a variable axial play of the individual slide shoes on the individual cylindrical studs. Depending on the play and on the rotational position of the torque shaft, the slide shoe can assume either its outermost or its innermost position, which permits the axial play; the linear contact between the slide shoe and the corresponding limiting surface of the cross groove of the control slide is present both farther inward and farther outward, so that the effective lever arm between this contact line and the axis of the torque shaft exhibits corresponding uncontrolled variations among the various adjusting elements which can lead to the above-mentioned error.

A desired reduction in the axial play must not, however, be allowed to reduce the rotational play of the guide shoe on the cylindrical stud. Only with this rotational play is a linear contact possible when the adjusting force is transmitted from the torque shaft to the control slide. Only by means of the linear force transmission can wear be diminished and the quality of control maintained even over long periods of operation.

OBJECT AND SUMMARY OF THE INVENTION

The fuel injection pump as defined has the advantage over the prior art that, because the length of the cylindrical stud is defined by the location of the head, the slide shoe is axially guided within very narrow tolerances and is axially secured without restriction of its rotational mobility. As a result, the contact line between the slide shoe and the corresponding cross groove face is always at the same point, depending on the rotational location of the torque shaft, thus assuring exact replicability of the various control positions as a function of a given rotational location. Better axial guidance also prevents reciprocation of the slide shoe from causing deflection in the end positions, which would make any errors even greater. The slide shoe may be guided on the face end remote from the adjusting element, for instance by means of a collar, provided thereon that axially limits the cylindrical stud, or by means of some other device that axially limits the cylindrical stud, such as a fastening part located between the adjusting element and the torque shaft.

In another embodiment of the invention, the head has at least one flattened portion on its side, thereby furnishing a guide face.

In a further advantageous embodiment of the invention, the end face of the slide shoe oriented toward the pump plunger has at least one protrusion, thereby forming with the flattened portion of the head a means of rotationally securing the slide shoe on the cylindrical stud while allowing limited rotational play. According to the invention, two lateral flattened portions of this kind may be provided, which cooperate correspondingly with two protrusions the end face of the slide shoe, so that the head of the adjusting element serves as a double-sided rotational fixation for the slide shoe. This fixation enables a rotational movement of the slide shoe on the cylindrical stud as a function of the width of the gap between the flattened surfaces and the faces of the protrusion that are oriented toward them.

In a further embodiment of the invention, the head has at least one overhang, radially protruding beyond the stud and narrower than the stud diameter, and the central bore in the slide shoe has a radial enlargement, so that the slide shoe can be slipped onto the adjusting bolt via the overhang and axially secured on the stud by being rotated about a certain angle, because the overhang now grips it from behind. The head is preferably tapered on two sides to form an anchor corresponding to the two overhangs. With this kind of bayonet mount, the slide shoe can be replaced when it becomes worn, without having to disconnect the adjusting element from the torque shaft. Naturally an anchor with three hooks can be used instead of one with two, and in that case the head is machined correspondingly, and three enlargements for attaching the slide shoe are correspondingly provided in the central bore.

In another advantageous embodiment of the invention, the slide shoe has at least one radial flattened portion, which permits limited rotary play and cooperates with a protrusion, adjacent to the flattened portion and having a parallel face, of the securing element. As in the other embodiments described above, this effects a rotation limitation of the slide block, which can be manufactured very simply and reliably. By providing the flattened portion on the slide shoe, a relatively large surface area is furnished, which prevents rotation.

In yet another advantageous embodiment of the invention in which a securing element of the adjusting element is embodied as a straddling element, there is a retaining stud, which is offset on the adjusting bolt relative to the cylindrical stud bearing the slide shoe. By means of this retaining stud, the adjusting element bolt is secured on the straddling element and secured in a securing bore located at that point. In another embodiment of the invention, the adjusting element bolt may be embodied as a stepped bolt, having the cylindrical stud supporting the slide shoe, and the retaining stud has a smaller diameter and is nonrotatably secured in the securing bore; the step formed between the cylindrical stud and the retaining stud thereby determines the axial length of the cylindrical stud, in that the portion having the securing bore axially guides the slide shoe.

The securing of the adjusting element on the straddling element can be done in accordance with the invention in at least one of the following three ways. The adjusting element may be anchored on the straddling element by means of a cross pin passing through the retaining stud and the stradding element; or the retaining stud is secured in the securing bore by laser beam welding; or the retaining stud is riveted into the securing bore. Each of these securing methods is reliable and easy to do. The stepped face formed between the cylindrical stud and the retaining stud serves as a bearing surface or counterpart clamping surface. Naturally this kind of embodiment as a stepped bolt may also be advantageous with a hard-soldered connection or some other kind of connection, because by having the step and the part having the securing bore, a collar on the adjusting bolt can be dispensed with. A shim can be disposed between the stepped face and the end face of the slide shoe.

In another advantageous embodiment of the invention, for which independent protection is sought, the adjusting element, in contrast to the slide shoe, is of a plastically deformable material (untempered steel), because on the one hand the narrow tolerance between the cylindrical stud and the slide shoe bore provides a favorable transmission of force over a large surface area between the adjusting bolt and the slide shoe, and on the other hand, rotational motions of the slide shoe on the adjusting bolt, which cause wear, are virtually prevented. Because of the plastically deformable material, it becomes very much simpler to secure the adjusting element to the securing part for the torque shaft, because a softer material is not only easier to work with in riveting, but in hard soldering or other securing methods as well. The slide shoe itself is of hardened material, because the actual sliding motions toward the control slide, which can cause wear, take place on the slide shoe.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
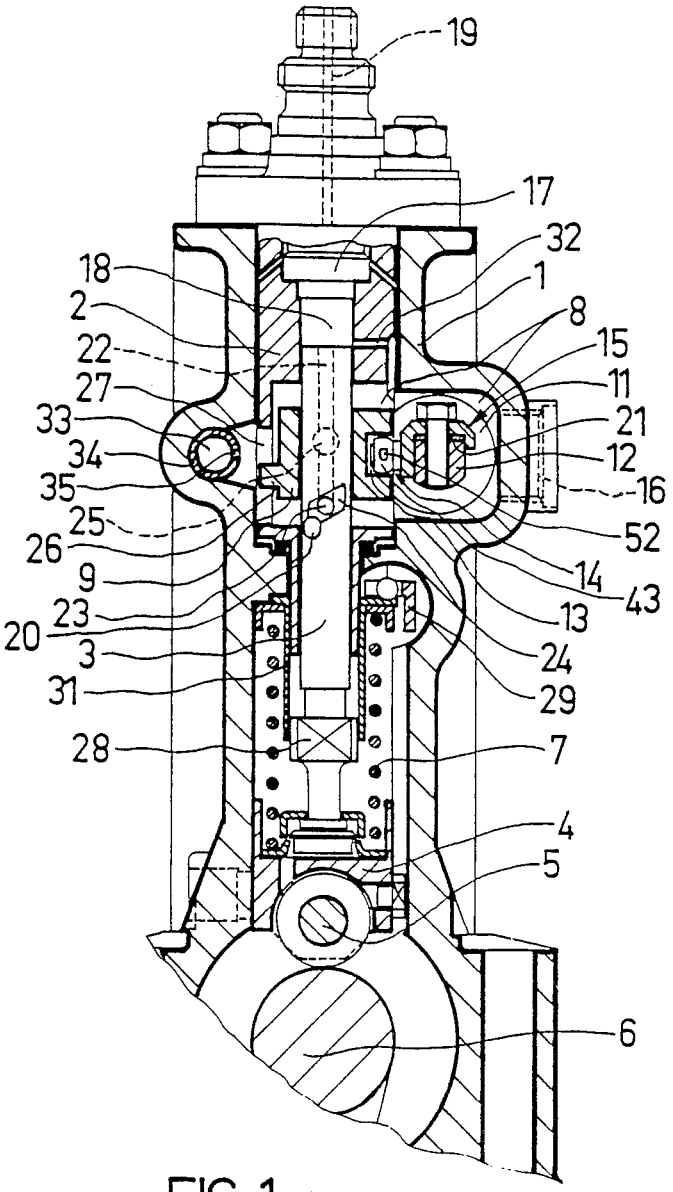
FIG. 1 is a vertical section through a fuel injection pump in which the invention can be used.

In the injection pump shown in FIG. 1, which is applicable to all the exemplary embodiments, a plurality of linearly aligned cylinder liners 2 are arranged in a housing 1, only one of these being visible in the sectional view shown. In each of the cylinder liners 2, a pump plunger 3, with an interposed roller tappet 4 that has a roller 5, is driven for its axial motion embodying the working stroke by a camshaft 6 counter to the pump feed pressure and counter to the force of a spring 7. A suction chamber 8 formed from recesses in the cylinder liners 2 and hollow spaces in the housing 1 is associated with pump elements embodied by the cylinder liners 2 and pump plungers 3. One control slide 9 per pump plunger is axially displaceable on the pump plungers 3 in the recesses of the cylinder liners 2. The suction chamber 8 is closed at the longitudinal ends by bearing plates 11, one of which is shown in plan view and in which a torque shaft 12 disposed in the suction chamber 8 is supported. Disposed in the control slide 9 is a cross groove 13 which is engaged by an adjusting element 14 of a securing means, embodied as a straddling element 15, which is connected by a screw connection to the torque shaft 12. In the housing 1 are connection bores 32, one of which is shown, leading to the suction chamber 8.

The pump plunger 3, the cylinder liner 2 and a pressure valve 17 define a pump work chamber 18, from which a pressure conduit 19 leads to a pressure line, not shown, terminating at an injection nozzle of the engine. Located in the pump plunger 3 are a blind bore 22, shown in dotted line, terminating at its face end and discharging into the pump work chamber 18, and a cross bore 23 discharging into oblique grooves 24, one of which is shown on each of the sides remote from one another in the jacket face of the pump plunger 3. These oblique grooves 24 terminate at the bottom in countersunk bores 20 and cooperate with radial bores 25 of the control slide 9.

To secure the control slide 9 against torsion, in its axial displacement on the pump plunger 3, and to assure a precise orientation of the oblique grooves 24 with respect to the radial bores 25, the control slide 9 has a protrusion 26, with which it engages a longitudinal groove 27 of the cylinder bushing 2.

On its lower circumferential portion, the pump plunger 3 has flattened portions 28, which are engaged by a bushing 31 that is rotatable in a known manner by a governor rod 29, so that an axial displacement of the governor rod 29 causes a rotation of the pump plunger 3, and hence a change in the orientation of the oblique grooves 24 with respect to the radial bores 25.

An intake bore 32 extends in the cylinder liner 2 and in the pump housing, between the suction chamber 8 and the pump work chamber 18, and is opened by the pump plunger 3 when the pump plunger is in its bottom dead center position (as shown in the drawing).

The supply of fuel to the suction chamber 8 is effected via the longitudinal groove 27 from an inflow conduit 33, which extends in a tube 34 disposed in the housing 1 and having branching openings 35 leading toward the longitudinal grooves 27.

This fuel injection pump operates as follows:

Toward the end of the intake stroke, or at the bottom dead center position of the pump plunger 3, fuel flows via the oblique bore 24, the cross bore 23 and the blind bore 22 as well as via the intake bore 32 into the pump work chamber 18, filling it. As soon as the roller tappet 4 is displaced upward via the roller, after suitable continued rotation of the camshaft 6, the pump plunger 3 closes intake bore 32 and positively displaces fuel out of the pump work chamber 18. Until the oblique grooves 24 and the blind bores 20 have moved all the way into the control slide 9, the pumping from the pump work chamber 18 continues via the course described back to the suction chamber 8; initially, a certain amount is also returned by positive displacement via the intake bore 32. As long as the oblique grooves 24 and countersunk bores 20 remain fully contained in the control slide 9, an injection pressure can build up in the pump work chamber 18; after that, the fuel pumping to the engine is effected via the pressure conduit 19. This actual injection stroke of the pump plunger 3 is interrupted once the oblique grooves 24 come into coincidence with the radial bores 25 in the control slide 9, causing the fuel to be pump out of the pump work chamber 18 back into the suction chamber 8. Depending on the rotational position of the pump plunger 3, which is determined by the governor rod 29, this actual injection stroke is of variable length, because as a function of the rotational position, the oblique grooves 24 enter into coincidence with the radial bores 25 only after a certain length of the stroke has been executed. This determines the injection quantity. The injection onset, on the other hand, is determined by the axial position of the control slide 9, which in turn is effected by the torque shaft 12 or the straddling connecting element 15 with adjusting means 14. The higher the control slide is moved by displacement, the later the injection onset (entry of the oblique grooves 24 into the control slide 9), and the later the functional cessation of the injection, so that the quantity determined by the rotational position of the pump plunger 3 remains unaffected. This injection onset, or the end of injection, must agree for the pump elements of one row.

In the three exemplary embodiments shown in FIGS. 2–7, the angularly embodied straddling connecting element 15, 115, 215 is clamped to the torque shaft 12, 112 via a screw bolt 36; a spacer washer 37 is disposed between the straddling connecting element 15, 115 and the torque shaft 12, 122, and a shim 38 is disposed between the head of the screw bolt 36 and the straddling connecting element 15, 115. In the third exemplary embodiment shown in FIGS. 6 and 7, the torque shaft, bolt, spacer and shim are not shown. The thickness of the spacer washer 37 may be different for each different control and is selected such that the various adjusting means 14 and control slide 9 can be adjusted in their basic position relative to one another.

A securing bore 39, 139, 239 is disposed in the straddling connecting element 15, 115, 215, and the adjusting means 14 is secured in this bore with a retaining stud 41, 141, 241. The adjusting means 14 also has a cylindrical stud portion 42, 142, 242, on which a slide shoe 43, 143, 243 is supported and guided in an easily rotatable manner and with little axial play. This cylindrical stud portion is defined in its length by a head 44, 144, 244, which at the same time serves as an axial stop for the slide shoe 43, 143, 243.

Figure 2:
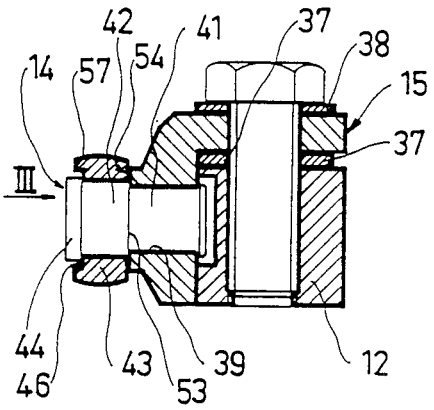
FIG. 2 is a section through the first exemplary embodiment taken along line II—II of FIG. 3, shown on a larger scale.
Figure 3:
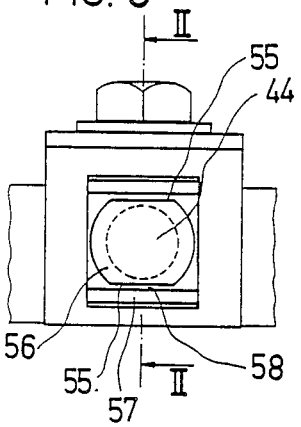
FIG. 3 is a view in the direction of the arrow III in FIG. 2.

In the first exemplary embodiment shown in FIGS. 2 and 3, the slide shoe 43 is nonremovably joined to the straddling connecting element 15. The retaining stud 41 in this embodiment has a smaller diameter than the cylindrical stud portion 42 on which the slide shoe 43 is supported. For securing the adjusting means 14 on the straddling connecting element 15, the retaining stud 41 is riveted in place, and a stepped face 53 rests directly on a corresponding face 54 of the straddling connecting element 15. This face 54 also serves as axial guidance for the slide shoe 43.

The head 44 of the adjusting means 14 has two flattened portions 55, and the remaining rim 56 of the head, in cooperation with the face end 46 of the slide shoe 43, serves as axial guidance for the slide shoe 43.

Strip-like protrusions 57 are disposed on the face end 46 of the slide shoe 43, their inside faces facing the flattened portions 55 and with them defining a gap 58, the width of which determines the possible rotation of the slide shoe 43 on the cylindrical stud 42. The rotational movement should be limited to approximately ±5°.

Figure 4:
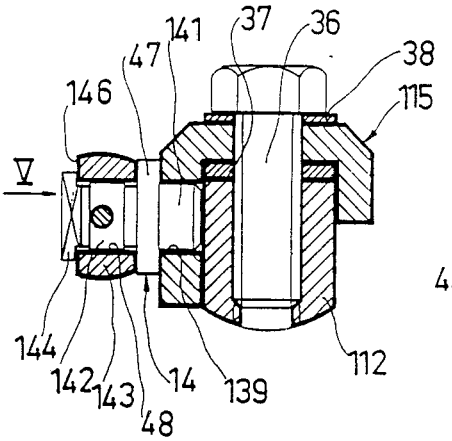
FIG. 4 shows the second exemplary embodiment in a section taken along the line IV—IV of FIG. 5.
Figure 5:
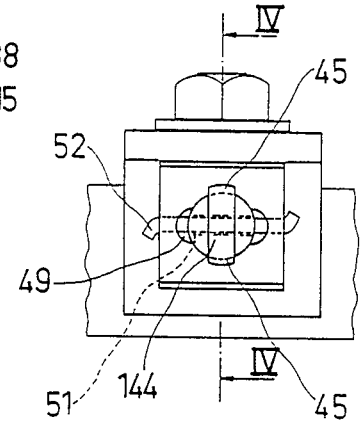
FIG. 5 is a view in the direction of the arrow V of FIG. 4.

In the second exemplary embodiment shown in FIGS. 4 and 5, the head 144 is laterally flattened, except for a remaining bar, so that oppositely extending areas 45 protrude outward beyond the diameter of the cylindrical stud 142 and these are arranged to grip the slide shoe 143 from behind on its face end 146 oriented toward the pump plunger 3. Between the retaining stud 141 of the adjusting means 14 and the cylindrical stud 142, there is a collar 47, toward which the other face end of the slide shoe 143 is oriented, and on which this face end also rests. To enable slipping the slide shoe 143 onto the cylindrical stud 142, two cut-out enlargements 49 are provided in the central bore 48 of the slide shoe 143, which are somewhat larger than the oppositely protruding areas 45, but small enough not to impair the radial guidance of the bore 48 on the stud 142. In assembly, the oppositely protruding areas 45 are pushed through the enlargements 49, after which the slide shoe is rotated 90° on the stud 142, resulting in a kind of bayonet mount with axial guidance of the slide shoe 143, in which the oppositely protruding areas 45 cooperate with the face end 146 of the slide shoe 143.

To prevent the slide shoe 43 from rotating backward on its own, a securing pin 52 is placed in a bore 51 penetrating the adjusting bolt 14 and the slide shoe 143; the ends of the securing pin 52 are bent at an angle to prevent the pin 52 from falling out. The retaining stud 141 may be laser welded hard-soldered in the securing bore 49. Once the securing pin 52 is removed and the slide shoe is rotated by 90°, the slide shoe 43 in this exemplary embodiment can be replaced, which may be advantageous if either the working face of the slide shoe is sufficiently worn, or a slide shoe having different radial dimensions is to be used.

Figure 6:
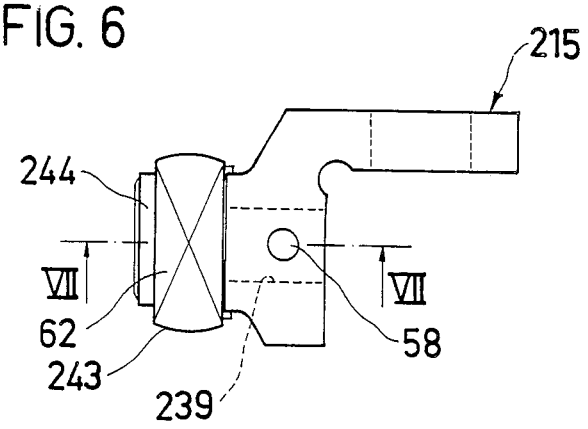
FIG. 6 shows the third exemplary embodiment in the side view taken in the direction of the arrow VI in FIG. 7.
Figure 7:
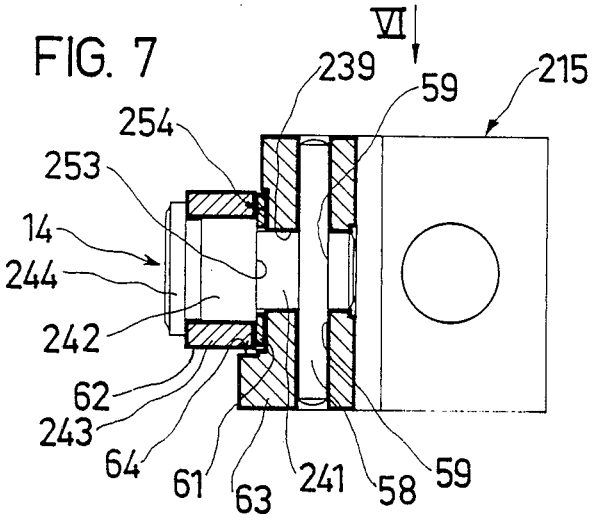
FIG. 7 is a section taken along the line VII—VII of FIG. 6.

In the third exemplary embodiment shown in FIGS. 6 and 7, the adjusting means 14 is releasably anchored in the securing bore 239 of the straddling connecting element 215. To this end a cross pin 58 is provided, which is disposed in a through bore 59 that through both the retaining stud 241 and corresponding portions of the straddling element 215 for receiving the cross pin 58.

Between the stepped face 253 of the adjusting means 14 and the face 254 facing it on the straddling connecting element 215, there is a shim 61, on which the face end of the slide shoe 243 is also supported.

While the head 244 of the adjusting means 14 serves only for axially securing the slide shoe 243, the slide shoe has flattened portions 62 located on opposite sides from one another in the adjustment direction. A protrusion 63 is provided at this point on the straddling element 215, having a face 64 toward and spaced slightly apart from one flattened portion 62, so that the slide shoe 243 can execute only a slight rotational movement on the cylindrical stud 242.

All the characteristics described above, recited in the ensuing claims and shown in the drawings may be essential to the invention either singly or in any arbitrary combination with one another.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A control device for axial displacement of at least one control slide relative to a pump piston in a fuel injection pump for internal combustion engines in which said control device comprises:

a rotatable shaft, a connecting element secured to said rotatable shaft, an adjusting means disposed on said connecting element secured to said rotatable shaft, said adjusting means including a radially projecting cylindrical stud, a slide shoe secured on said cylindrical stud of said adjusting means free of any axial displacement, said slide shoe engages a cross groove disposed on said control slide in order to convert a rotational motion of said rotating shaft into a reciprocating motion of said control slide, said cylindrical stud including a free end that forms an enlarged head (44, 144, 244) which engages one face end of said slide shoe (43, 143, 243) from behind to provide very little axial play by which said slide shoe is secured in its working position.

2. A fuel injection pump as defined by claim 1, in which said head (44, 144) has at least one lateral flattened portion (55).

3. A fuel injection pump as defined by claim 2, in which said one face end (46) of said slide shoe (43) oriented toward said enlarged head includes at least one protrusion (57) which cooperates with said flattened portion (55) of the head (44) to embody a rotational securing means which limits rotational play of said slide shoe (43) on said cylindrical stud (42).

4. A fuel injection pump as defined by claim 3, in which said protrusion (57) is embodied in strip-like fashion and extends parallel to said flattened portion (55).

5. A fuel injection pump as defined by claim 1, in which said enlarged head (144) has at least one overhang (45) radially exceeding said cylindrical stud (142), said overhang being narrower than the stud diameter, and said slide shoe includes a central bore (48) which has a radial enlargement (49) so that said slide shoe (143) can be slipped via said enlargement (49) onto said cylindrical stud (142) of said adjusting means (14) and can be axially secured by rotation about a certain angle on said stud by means of said overhand (45) gripping said slide shoe from behind.

6. A fuel injection pump as defined by claim 5, in which said head (144) is flattened except for a bar width that is narrower than a diameter of said cylindrical stud (142).

7. A fuel injection pump as defined by claim 1, in which said connecting element is embodied as a straddling element (215), for the adjusting means (14), in which said slide shoe (143) has at least one radial flattened portion (62), which cooperates with a protrusion (63) to permit a limited rotational play of said straddling element (215) adjacent to the flattened portion (62) and having a face (64) parallel to said flattened portion (62).

8. A fuel injection pump as defined by claim 1, in which said connecting element is embodied as a straddling element (15, 115, 215) of the adjusting means (14), said straddling element includes a securing bore, said adjusting bolt (14) includes an offset retaining stud (41, 141, 241) extending from said cylindrical stud (42, 142, 242) bearing the slide shoe (43, 143, 243), by means of which the adjusting bolt (14) is secured on said straddling element (15, 115, 215).

9. A fuel injection pump as defined by claim 8, in which adjusting means (14) is embodied as a stepped bolt including said cylindrical stud (42, 242) bearing the slide shoe (43, 143), and that said retaining stud (41, 241) has a smaller diameter than said cylindrical stud and is nonrotatably secured in the securing bore (39, 139, 239) of said straddling element, wherein a free length of said cylindrical stud (42, 242) is determined by a step (53, 253) formed between said cylindrical stud and said retaining stud.

10. A fuel injection pump as defined by claim 8, in which said adjusting means (14) is anchored on said straddling element (215) by means of a cross pin (58) penetrating said retaining stud (241) and said straddling element (215).

11. A fuel injection pump as defined by claim 8, in which said retaining stud (141) is secured by means of laser beam welding or hard soldering.

12. A fuel injection pump as defined by claim 9, in which said retaining stud (41) is riveted in place in said securing bore (39).

13. A fuel injection pump as defined by claim 9, in which a shim (61) is disposed between a stepped face (253) of said adjusting means (14) and an opposite face (254) of said straddling element (215).

14. A fuel injection pump as defined by claim 8, in which said adjusting means (14) is made of plastically deformable material.

15. A fuel injection pump as defined by claim 7, in which said adjusting means (14), includes a retaining stud (241) offset from said cylindrical stud (242) bearing the slide shoe (243), by means of which said adjusting means (14) is secured on said straddling element (215) and in a securing bore (239) provided in said straddling element.

16. A fuel injection pump as defined by claim 15, in which said adjusting means (14) is embodied as a stepped bolt comprising said cylindrical stud (242) bearing said slide shoe (143), and that said retaining stud (241) has a smaller diameter and is nonrotatably secured in said securing bore (239) of said straddling element, wherein a free length of said cylindrical stud (242) is determined by a step (253) formed between said cylindrical stud and said retaining stud.

17. A fuel injection pump as defined by claim 16, in which said adjusting means (14) is anchored on said straddling element (215) by means of a cross pin (58) penetrating said retaining stud (241) and said straddling element (215).

18. A fuel injection pump as defined by claim 16, in which said retaining stud is secured by means of laser beam welding or hard soldering.

19. A fuel injection pump as defined by claim 16, in which a shim (61) is disposed between a stepped face (253) of the adjusting means (14) and an opposite a face (254) of said straddling element (215).

20. A fuel injection pump as defined by claim 19, in which said adjusting means (14) is made of plastically deformable material.

* * * * *